United States Patent [19]

Garshfield

[11] 3,950,800

[45] Apr. 20, 1976

[54] MODULAR MATTRESS STRUCTURE

[75] Inventors: Arthur H. Garshfield, Los Angeles, Calif.

[73] Assignee: Debra Karen Garshfield; Gary Neil Garshfield, both of Los Angeles, Calif.

[22] Filed: Mar. 25, 1975

[21] Appl. No.: 561,849

[52] U.S. Cl. ..... 5/351; 5/354; 5/334 C

[51] Int. Cl.[2] ..... A47C 23/04

[58] Field of Search ..... 5/320, 335, 336, 345, 5/351, 334 C, 354

[56] References Cited

UNITED STATES PATENTS

| | | | |
|---|---|---|---|
| 2,907,055 | 10/1959 | Berman | 5/334 C |
| 2,923,014 | 2/1960 | Hume | 5/320 |
| 3,027,573 | 4/1962 | Bell, Jr. | 5/351 |
| 3,287,749 | 11/1966 | Marsico | 5/351 |

*Primary Examiner*—Casmir A. Nunberg
*Attorney, Agent, or Firm*—Ralph B. Pastoriza

[57] ABSTRACT

A mattress is made up of a central core, insulators on either side, pads of stuffing on the insulators and a cover with a zipper closure and an inner flange holding the components in place. By providing discrete components with the uniquely designed cover, untrained personnel can separate one or more components of the mattress which may require repair or replacement all to the end that mattresses need not be sent out to a factory or mattress renovator.

5 Claims, 4 Drawing Figures

MODULAR MATTRESS STRUCTURE

This invention relates to bed mattresses and more particularly to a modular mattress structure facilitating the servicing of mattresses.

BACKGROUND OF THE INVENTION

Conventional mattresses (not including slip covers which simply fit over the mattresses) are made by specially designed machines utilizing highly trained personnel. In the event one component of a mattress becomes unusable, it is accordingly necessary to transport the mattress to a factory where it is disassembled and remanufactured after replacing the defective component.

The foregoing can become a relatively large item of expense, particularly in hospitals or other places where large numbers of matrresses are used. Not only is a mattress not available for use while it is being repaired at the factory thus increasing the necessary mattress inventory, but unnecessary costs are oftentimes entailed in the refurbishing of the entire mattress. This unnecessary cost is a consequence of the fact that rarely do all components of a mattress wear out at the same time. Nevertheless, when replacing a defective component at the factory it is not unusual that other components to which the defective component is secured are also replaced.

BRIEF DESCRIPTION OF THE PRESENT INVENTION

With the foregoing in mind, the present invention contemplates the provision of a unique modular mattress structure wherein various components making up the mattress can be readily replaced by untrained personnel directly at the site where the mattress is used; for example, a hospital or hotel. As a consequence, it is no longer necessary to send out such mattresses for renovation.

Briefly, the invention in its broadest aspects comprises a mattress cover made up of top and bottom panels, each panel including a peripheral skirt secured to the entire perimeter of the panel and having a zipper so that the panels can be opened away from each other. At least one panel includes an inner flange secured to the intersection of the skirt and panel perimeter. A mattress core (spring assembly or polyfoam) is positioned between the top and bottom cover panels with the inner flange engaging about the periphery of the core to hold it in position when closing the cover over the mattress core by the zipper. Insulators and pads of stuffing may also be included, these latter components being held in place by the flange.

With the foregoing arrangement, it is apparent that each of the components can readily be separated from the others by untrained personnel and yet when the components are assembled, a complete and secure mattress is provided.

BRIEF DESCRIPTION OF THE DRAWINGS

A better understanding of this invention will be had by referring to the accompanying drawings in which.

DETAILED DESCRIPTION OF THE INVENTION

Figure 1:
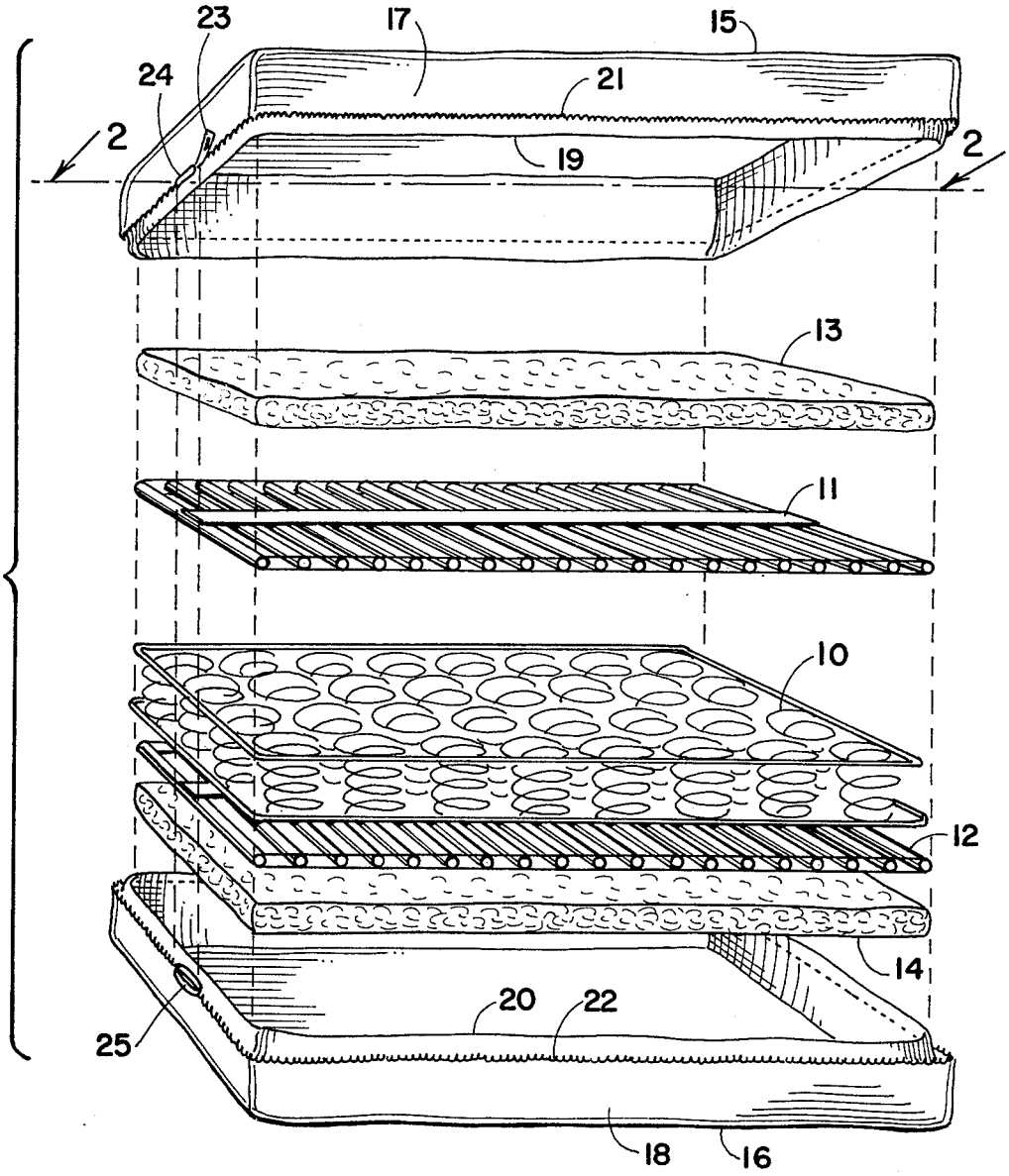
FIG. 1 is an exploded view of the basic components making up a first embodiment of the modular mattress structure.

Referring first to the central portion of FIG. 1 there is shown a coiled spring assembly defining a central core 10. This central core 10 is similar to a mattress structure.

Top and bottom screens made up of wires running transversely as indicated are shown at 11 and 12 and define insulators receivable on the top and bottom surfaces of the core. Top and bottom pads of stuffing 13 and 14 in turn are receivable on the top and bottom screens respectively. The screens or insulators 11 and 12 serve the function of preventing the cotton or other type stuffing becoming entangled in the coils making up the core 10.

The structure is completed by the provision of a cover which is shown separated in FIG. 1 and defined by top and bottom panels 15 and 16 of cloth-like material. These panels are essentially mirror images of each other and include a peripheral skirt such as shown at 17 for the panel 15 and 18 for the panel 16. This skirt extends about the entire perimeter of the panels.

The top and bottom panels also include an annular flange secured to the inside edges of these panels where the panels connect to the skirt, each of the flanges extending beyond the ends of the skirt. These annular flanges are shown at 19 and 20 for the panels 15 and 16 respectively and cooperate to engage about the entire periphery of the pads 13 and 14 and other components when the mattress is assembled thus holding these components in place.

As shown in FIG. 1, the free hanging ends of the skirts 17 and 18 include cooperating zipper closure means 21 and 22, a zipper pull tab 23 being illustrated for the top panel 15. As stated, the panels 15 and 16 are normally secured together but are shown in exploded view for convenience in FIG. 1. Actually, one portion of the skirt 17 for the top panel 15 indicated at 24 is sewn or otherwise secured to a corresponding portion 25 of the skirt 18 for the bottom panel 16. Complete securement of the top and bottom panels and skirts making up the cover is accomplished by zipping over a major portion of the periphery by means of the zipper pull-tab 23.

Figure 2:
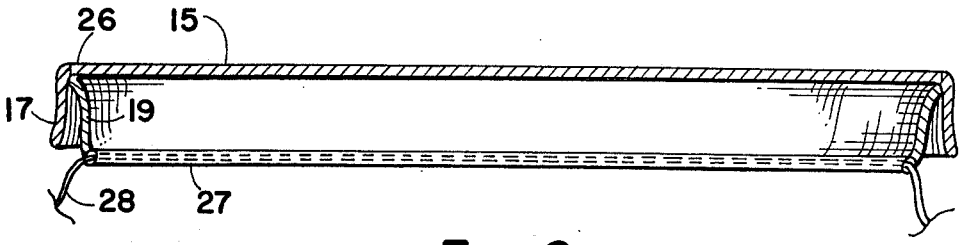
FIG. 2 is a cross section of a portion of the cover component taken in the direction of the arrows 2—2 of FIG. 1.

Referring to FIG. 2, an important feature of the present invention in conjunction with the covers is illustrated. More particularly, it will be noted that the upper end of the flange 19 for the panel 15 connects continuously over the entire perimeter of the panel 15 at 26; that is, the junction of the skirt 17 with the panel periphery as described. The lower free extending end of this flange, on the other hand, terminates in a rolled portion at 27 which incorporates an inextensible cord 28 of perimeter less than the perimeter of the panel 15.

The lower panel 16 of the cover similarly has its annular flange 20 shown in FIG. 1 secured to the junction of the skirt and panel perimeter and its free extending end including an inextensible cord of perimeter less than the perimeter of the panel 16.

Figure 3:
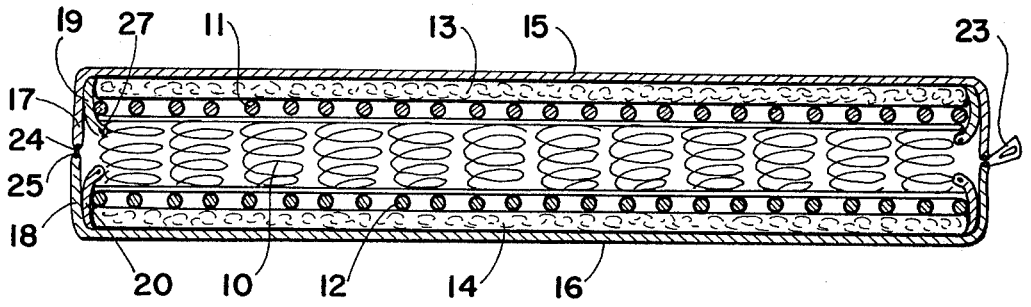
FIG. 3 is a cross section of the various components in assembled relationship; and, FIG. 4 illustrates a second embodiment.

The significance of the foregoing will best be understood by referring to the assembled cross section of FIG. 3. In FIG. 3, the various components described in FIG. 1 are in their assembled relationship and it will be noted that the flanges 19 and 20 are respectively received over and tucked inwardly of the top and bottom marginal edges of the central core 10 over the entire perimeter of the core so as to secure the insulators 11 and 12 and the pads of stuffing 13 and 14 in place. Thus, as a result of the use of the inextensible cord 28 described in FIG. 2 at the free ends of each of the flanges wherein this cord is of a perimeter less than the perimeter of the panels themselves the cover panels are thoroughly anchored to the remaining components and any sliding of the panels making up the cover is prevented.

Figure 4:
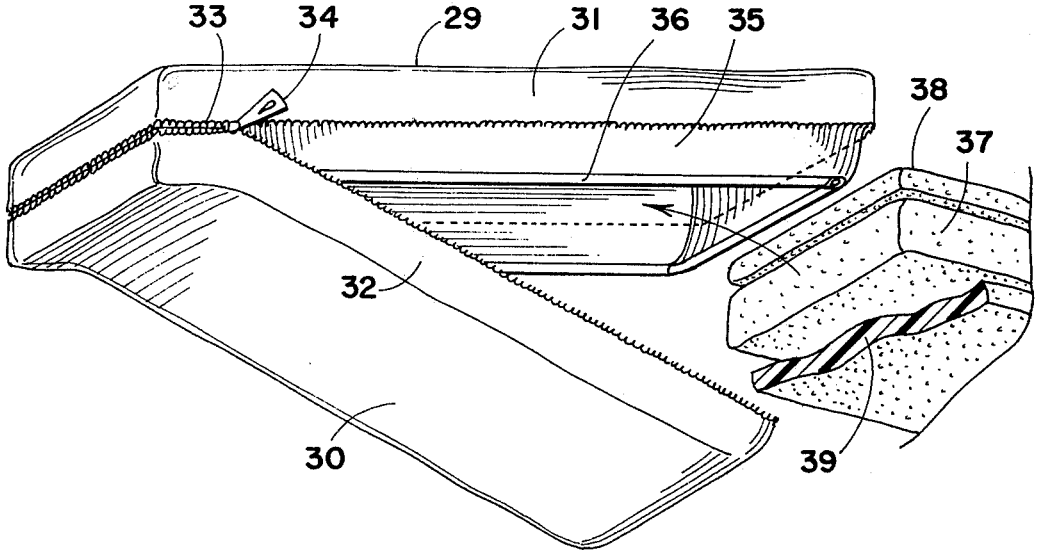

Referring now to FIG. 4, there is shown a second embodiment of the invention wherein the cover panels are similar to those described in FIG. 3 except that only one flange is associated with one of the panels.

Thus, as shown in FIG. 4 there is provided a cover including top and bottom panels 29 and 30 each provided with peripheral skirts 31 and 32 respectively. Zipper closure means are provided on the skirts as shown at 33, there being provided a pull tab 34 all in the manner described with respect to the embodiment of FIGS. 1 to 3.

In the cover of FIG. 4 there is only provided a single annular flange which, by way of illustration, is shown at 35 secured to the inner section of the skirt 31 with the perimeter of the top panel 29. It will be noted that the flange 35 extends beyond the end of the skirt 31 a substantially greater distance than is the case with the flanges described in the embodiment of FIGS. 1 to 3.

The skirt 35 incorporates at its lower extending end 36 an inextensible cord of perimeter less than the perimeter of the top panel 29.

The embodiment of FIG. 4 is designed particularly for use with a polyfoam mattress which is shown in partial fragmentary perspective view at 37, preparatory to being received between the top and bottom panels of the cover. When so received between the covers, the annular flange 35 will engage about the entire periphery of the polyfoam core 37, the inextensible cord portion at the lower end of the flange tucking under the entire lower perimeter of the core. Thus, the core will be held securely in place.

In addition, in FIG. 4, there may be provided additional components such as a pad of stuffing 38 on the top of the core 37. This pad of stuffing may comprise cotton or in certain instances polyester fibers. A bottom pad 39 may also be provided if desired.

OPERATION

In operation of the modular mattress structure described in FIGS. 1 to 3, it will be immediately evident that any untrained person can readily disassemble the various components making up the mattress structure. Thus, should any one or more of the components need replacing, it is only necessary to unzip the cover and remove the particular damaged component.

With respect to the foregoing, the inner annular flanges 19 and 20 on the top and bottom panels 15 and 16 of the cover constitute important structural components of this invention. These flanges not only hold the insulator and stuffing pads in place while working on or moving the mattress but in addition, serve to partially compress the cotton or polyester batting of the pads before final assembly so that machinery is not needed to complete the closure. Further, the flanges serve to align the zipper so that it can be easily opened and closed and also eliminates the need for straps which can be broken, torn or misaligned during assembly.

The cover component itself with the flanges enables it to be easily used with existing pre-built inner spring or polyfoam core mattresses without modification.

In the embodiment of FIG. 4, the cover with the single flange would normally be used, as stated, with a polyfoam type mattress by itself or with the possible addition of a cover pad. Because of the greater extension of the single flange, it will engage about the bottom marginal edge of the polyfoam mattress. Easy replacement can be carried out with the embodiment of FIG. 4 the same as described with respect to FIGS. 1 to 3.

It will be appreciated from the foregoing description, that untrained personnel at hospitals or hotels can actually assemble a complete mattress from available components. Further, in the case of mattresses used in both hospitals and hotels, it is easy for personnel to unzip the cover and periodically spray the inner components with disinfectant and/or deodorizers.

As previously mentioned, an important advantage of this invention is the fact that the mattresses can be repaired at the site where they are used, such as a hotel or hospital. This desirable feature avoids the necessity of sending out large quantities of mattresses at one time for renovation. Ordinarily, it is uneconomical for a hotel or hospital to simply send out one mattress at a time for renovation. Thus, the normal procedure is to wait until a large quantity of mattresses need repair and then send them out at one time. This policy thus requires the hotel or hospital to maintain a large inventory of mattresses on hand. The present invention avoids the foregoing problems and expense.

Further, because of the modular arrangement, the stiffness or softness of a mattress may readily be changed by simply substituting a different component such as a stiffer pad of stuffing or a more resilient pad of stuffing.

What is claimed is:

1. A modular mattress structure made up of separable component parts including, in combination:

a. a central core; and b. a cover defined by top and bottom panels of cloth-like material, each panel including a peripheral skirt about its entire perimeter and at least one panel having an annular flange secured to the inside edges of the panel where the panel connects to the skirt, the flange extending beyond the end of the skirt and including within its free extending end an inextensible cord of perimeter less than the perimeter of the panel, the free hanging ends of the skirts of the top and bottom panels having cooperating zipper closure means about a major portion of their perimeters, one portion of the skirt on the top panel being secured to a corresponding portion on the skirt of the bottom panel, the bottom panel being turned upside down relative to the top panel so that its skirt extends upwardly, whereby the top and bottom panels may be received over the top and bottom of the central core, the free extending end of the flange being received over and tucked inwardly of the central core over the entire perimeter of the core so as to secure the panels in position on the core, closure of the zipper closure means securing the cover in place to provide a mattress structure which can be disassembled by hand to enable replacement of any one or more of its component parts.

2. A modular mattress structure according to claim 1, in which said separable component parts include top and bottom screens defining insulators receivable on the top and bottom surfaces of said central core; and top and bottom pads of stuffing receivable on the top and bottom insulators respectively, said flange being secured to said top panel and tucking into said central core about its top marginal edge to hold the top insulator and top pad of stuffing in place, said bottom panel including an annular flange secured to the inside edge of the panel where the panel connects to the skirt, the flange extending beyond the end of the skirt and including within its free extending end an inextensible cord of perimeter less than the perimeter of the bottom panel, said flange tucking into said central core about its bottom marginal edge to hold the bottom insulator and pad of stuffing in place.

3. A modular mattress structure according to claim 1, in which said central core is comprised of polyfoam.

4. A modular mattress structure according to claim 3, including at least one pad of stuffing on the top surface of said polyfoam core surrounded and held in place by said flange.

5. A modular mattress according to claim 4, in which said pad comprises polyester fiber.

* * * * *